US011458746B2

(12) United States Patent
Suzuki et al.

(10) Patent No.: US 11,458,746 B2
(45) Date of Patent: Oct. 4, 2022

(54) PRINTING APPARATUS AND CONVEYANCE CONTROL METHOD THEREOF

(71) Applicant: CANON KABUSHIKI KAISHA, Tokyo (JP)

(72) Inventors: Tomohiro Suzuki, Kanagawa (JP); Naoki Wakayama, Kanagawa (JP); Ryutaro Takahashi, Tokyo (JP); Masakazu Nagashima, Kanagawa (JP); Hideyuki Nozawa, Tochigi (JP); Waichiro Saiki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/315,047

(22) Filed: May 7, 2021

(65) Prior Publication Data

US 2021/0354484 A1 Nov. 18, 2021

(30) Foreign Application Priority Data

May 14, 2020 (JP) ..... JP2020-085493

(51) Int. Cl.
*B41J 11/66* (2006.01)
*B41J 11/42* (2006.01)
*B41J 15/00* (2006.01)

(52) U.S. Cl.
CPC ..... *B41J 11/425* (2013.01); *B41J 11/663* (2013.01)

(58) Field of Classification Search
CPC ..... B41J 11/425; B41J 11/663; B41J 15/005
See application file for complete search history.

(56) References Cited

U.S. PATENT DOCUMENTS

2010/0328392 A1* 12/2010 Kanazawa ..... B41J 15/005 347/104
2011/0211900 A1* 9/2011 Ueda ..... B41J 11/70 400/621
2021/0354483 A1* 11/2021 Hada ..... B41J 11/70

FOREIGN PATENT DOCUMENTS

JP 2009-220498 A 10/2009

* cited by examiner

*Primary Examiner* — Scott A Richmond
(74) *Attorney, Agent, or Firm* — Canon U.S.A., Inc. I.P. Division

(57) ABSTRACT

A printing apparatus includes a feeding unit, a conveyance unit, a cutting unit, and a control unit. The conveyance unit nips the print medium conveyed from the feeding unit by a first roller and a second roller, and conveys the nipped print medium. The cutting unit cuts the print medium. The control unit: (1) performs control to make a command speed of the first roller lower than a command speed of the second roller until a printhead printing reaches near a trailing edge of a printing length after printing has started, (2) performs control to make the command speed of the first roller higher than the command speed of the second roller when the printing has reached near the trailing edge of the printing length, and (3) subsequently controls the cutting unit configured to cut the print medium.

12 Claims, 6 Drawing Sheets

PRINTING APPARATUS AND CONVEYANCE CONTROL METHOD THEREOF

BACKGROUND

Field

The present disclosure relates to a printing apparatus and a conveyance control method thereof. In particular, the present disclosure relates to, for example, a printing apparatus that includes a full-line inkjet printhead and a conveyance control method of this apparatus.

Description of the Related Art

Conventionally, there is a printing apparatus that uses a rolled sheet as a print medium, uses a cutter to cut a printed portion when printing is completed, and discharges the cut printed portion outside the apparatus. In such a printing apparatus, in order not to stop the next printing operation, a rolled sheet is looped (slacked) on a conveyance path of the rolled sheet before the rolled sheet is cut, the conveyance of the rolled sheet which is closer to the downstream side than the looped portion is stopped when the rolled sheet is to be cut, and the rolled sheet is cut by using the time in which the loop is consumed.

In order to implement a more accurate rolled sheet conveyance, for example, Japanese Patent Laid-Open No. 2009-220498 includes the following control arrangement. That is, a unit for correcting the number of rotation pulses applied to a conveyance motor for driving a conveyance roller and a unit for controlling a loop amount are included, control is performed by reducing the loop amount if a sheet length designated by a print job is a predetermined length or more, and control is performed without reducing the loop amount if the sheet length is less than the predetermined length. By such control, tension acts on the rolled sheet while the loop amount has been reduced, and the skewing and the meandering of the rolled sheet on the conveyance roller can be suppressed.

In addition, a rotation pulse correction value of the conveyance motor that conveys the conveyance roller is switched in accordance with whether the designated sheet length is equal to or more than a predetermined value (whether loop amount reduction control is present). As result, a conveyance shift between an actual sheet conveyance amount and the number of pulses caused by a difference in the tension applied to the sheet due to the magnitude of the loop amount can be corrected. Subsequently, in a case in which the loop amount has been reduced, the rolled sheet will be cut after a sufficient loop has been formed by increasing the loop amount when the remaining sheet length to the completion of a page undergoing printing has become equal to or less than a predetermined length.

In this arrangement, since a uniform rotation pulse correction value will be used for the conveyance moor during a print job, the conveyance of the rolled sheet in the entire single print job can be implemented highly accurately.

However, in the above-described conventional example, if control is performed to reduce the loop amount, the tension acting on the rolled sheet will rapidly change at the point of time at which the loop amount is changed midstream, and the conveyance amount of the rolled sheet will rapidly change before and after the change in the loop amount. Such a rapid change in the conveyance amount can make the printed image nonuniform and degrade the image quality.

SUMMARY

The disclosure provides information regarding a printing apparatus that can implement highly accurate conveyance of a print medium and print a high quality image, and a conveyance control method of this apparatus.

According to an aspect of the present disclosure, a printing apparatus to convey a print medium that is continuous and to use a printhead to perform printing on the conveyed print medium, includes a feeding unit configured to feed the print medium, a conveyance unit configured to nip the print medium conveyed from the feeding unit by a first roller and a second roller which is arranged closer to a downstream side than the first roller with respect to a conveyance direction of the print medium, and to convey the nipped print medium, a cutting unit configured to cut the print medium, wherein the cutting unit is arranged closer to an upstream side than the first roller with respect to the conveyance direction of the print medium, and a control unit configured to control the conveyance of the print medium and an operation of the cutting unit, wherein the control unit: (1) performs control to make a command speed of the first roller lower than a command speed of the second roller until printing by the printhead reaches near a trailing edge of a printing length after the printhead has started the printing on the print medium conveyed by the conveyance unit, (2) performs control to make the command speed of the first roller higher than the command speed of the second roller when the printing by the printhead has reached near the trailing edge of the printing length, and (3) subsequently performs control to control the cutting unit configured to cut the print medium.

Further features of the present disclosure will become apparent from the following description of exemplary embodiments (with reference to the attached drawings).

DESCRIPTION OF THE EMBODIMENTS

Figure 1:
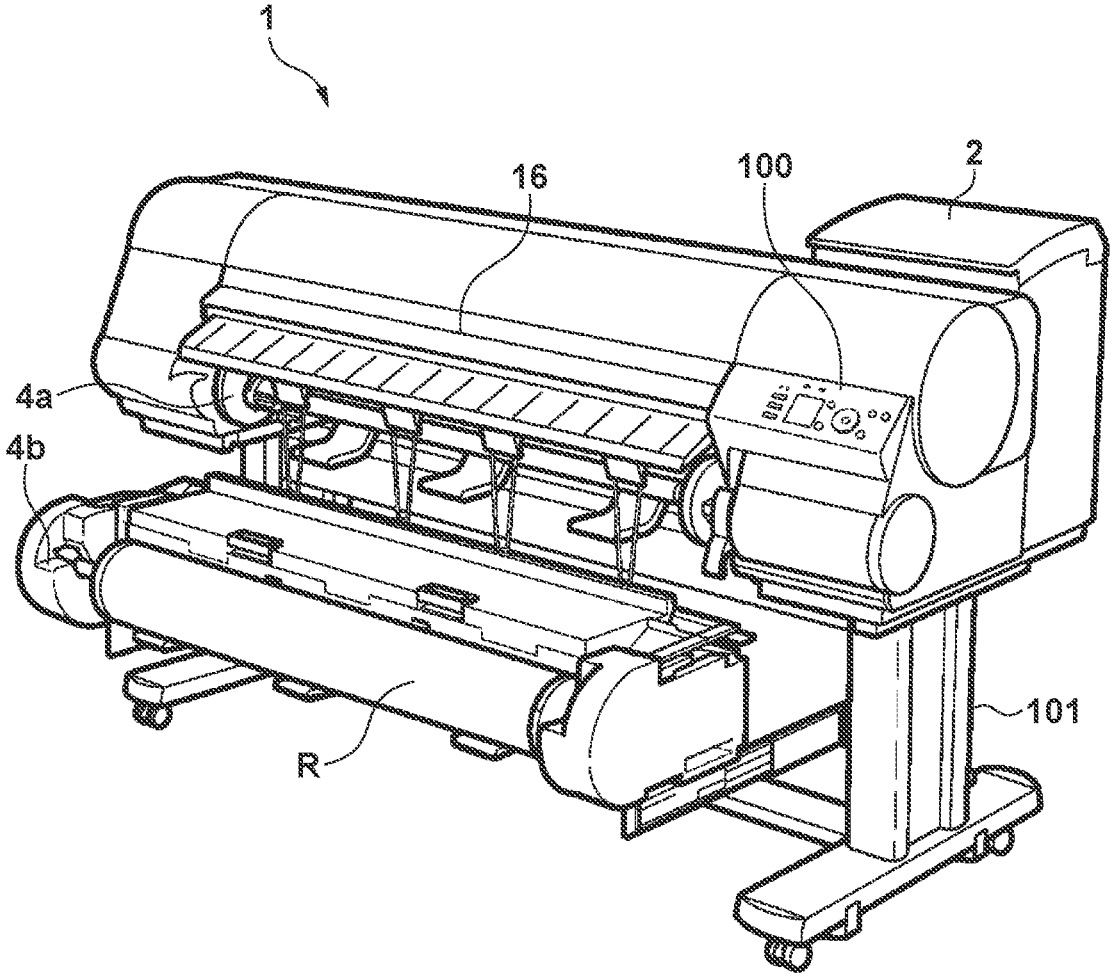
FIG. 1 is an outer perspective view showing the schematic arrangement of an inkjet printing apparatus according to an embodiment of the present disclosure.

Hereinafter, embodiments will be described in detail with reference to the attached drawings. Note, the following embodiments are not intended to limit the scope of the terms of the claims. Multiple features are described in the embodiments, but not all such features are required, and multiple such features may be combined as appropriate. Furthermore, in the attached drawings, the same reference numerals are given to the same or similar configurations, and redundant description thereof is omitted.

Note that in this specification, the term "printing" (to be also referred to as "print" hereinafter) not only includes the formation of significant information such as characters and graphics, regardless of whether they are significant or insignificant. Furthermore, it broadly includes the formation of images, figures, patterns, and the like on a print medium, or the processing of the medium, regardless of whether they are so visualized as to be visually perceivable by humans.

In addition, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to also be referred to as a "liquid" hereinafter) should be extensively interpreted similar to the definition of "printing (print)" described above. That is, "ink" includes a liquid which, when applied onto a print medium, can form images, figures, patterns, and the like, can process the print medium, or can process ink (for example, solidify or insolubilize a coloring material contained in ink applied to the print medium).

Further, a "nozzle" generically means an orifice or a liquid channel communicating with it, and an element for generating energy used to discharge ink, unless otherwise specified.

A substrate for a printhead (head substrate) used below means not merely a base made of a silicon semiconductor, but a configuration in which elements, wirings, and the like are arranged.

Further, "on the substrate" means not merely "on an element substrate", but even "the surface of the element substrate" and "inside the element substrate near the surface". In the present disclosure, "built-in" means not merely arranging respective elements as separate members on the base surface, but integrally forming and manufacturing respective elements on an element substrate by a semiconductor circuit manufacturing process or the like.

Outline of Printing Apparatus (FIG. 1)

FIG. 1 is an outer perspective view of an inkjet printing apparatus (to be referred to as a printing apparatus hereinafter) according to an embodiment of the present disclosure.

As shown in FIG. 1, a printing apparatus 1 is provided with an operation panel 100 for setting various kinds of settings related to printing and displaying the state of the apparatus. In addition, the printing apparatus 1 is supported by a stand 101, and its printing unit is normally covered by a cover 16 that can open and close. Furthermore, the printing apparatus 1 includes an ink tank cover that is operated when an ink tank is to be replaced. As will be described later, the printing apparatus 1 includes a full-line printhead (to be referred to as a printhead hereinafter) that has a printing width corresponding to a width direction of a print medium and prints an image by discharging ink droplets on the print medium.

The printhead is formed by four color printheads for black (K), cyan (C), magenta (M), and yellow (Y) that have the same arrangement. Hence, four ink tanks containing black ink, cyan ink, magenta ink, and yellow ink, respectively, are stored in a lower portion of the ink tank cover. These ink tanks can be replaced independently of each other.

A print medium, for example, a rolled sheet having a width of 10 inches to 60 inches is mounted in correspondence with the printing width of the printhead in the printing apparatus 1, and printing can be performed by conveying the print medium to a printing region of the printhead.

Note that as shown in FIG. 1, the print medium which is like a rolled continuous sheet can be stored in two stages (an upper rolled sheet attachment portion 4*a* and a lower rolled sheet attachment portion 4*b*), and printing can be performed on either attached rolled sheet. Note that FIG. 1 shows a state in which a rolled sheet R has been attached to the lower rolled sheet attachment portion 4*b*.

The structure of the printhead will be described in detail next.

Figure 2:
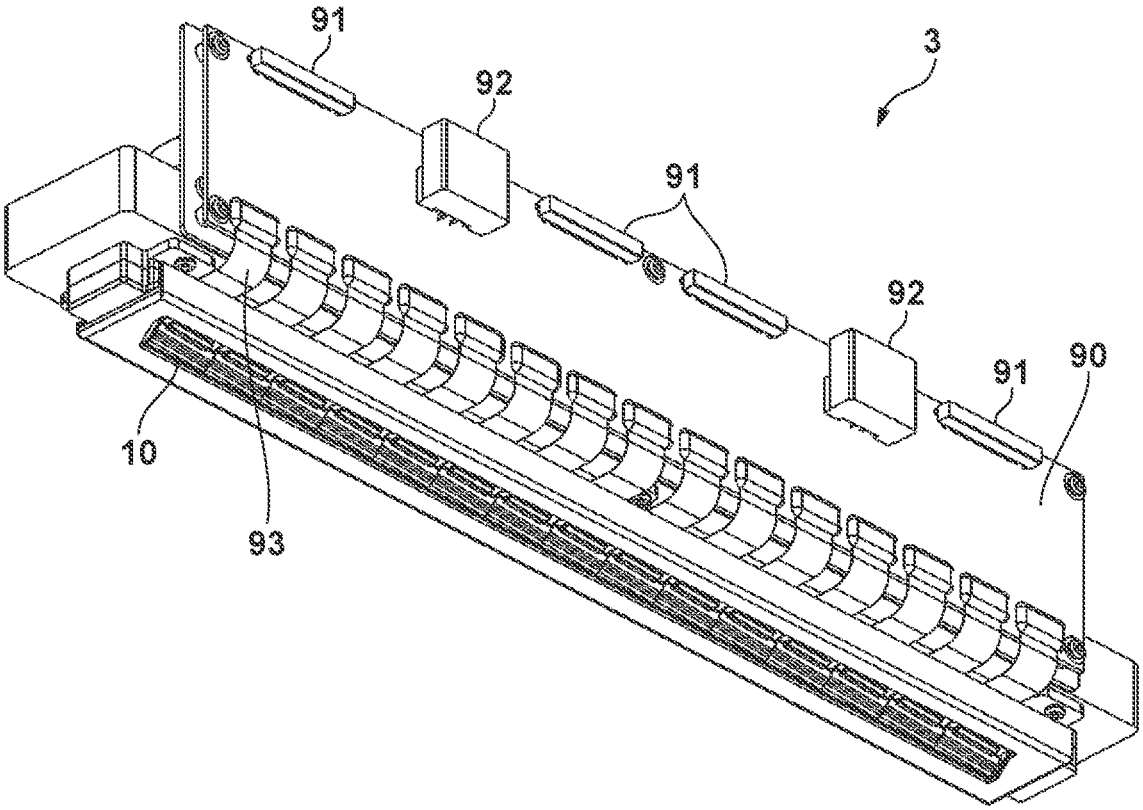
FIG. 2 is a perspective view showing the schematic arrangement of a printhead.

Description of Arrangement of Printhead (FIG. 2)

FIG. 2 is a perspective view showing the schematic arrangement of a printhead 3. The printhead 3 is a line printhead in which 15 element substrates 10 that can discharge four color inks of C/M/Y/K have been linearly arranged (arranged in line). Note that other than this kind of an arrangement, four printheads 3, each configured to discharge one color ink, may be arranged in the conveyance direction of the print medium so as to discharge four color inks of C/M/Y/K.

As shown in FIG. 2, the printhead 3 includes signal input terminals 91, each electrically connected to a corresponding element substrate 10 via a flexible wiring substrate 93 and an electric wiring substrate 90, and power supply terminals 92. Each signal input terminal 91 and each power supply terminals 92 are electrically connected to a control unit of the printing apparatus 1 and supply a discharge driving signal and power necessary for discharge, respectively, to the corresponding element substrate 10. By integrating the wiring lines by an electric circuit in the electric wiring substrate 90, the number of the signal input terminals 91 and the number of the power supply terminals 92 can be less than the number of the element substrates 10. As a result, fewer electrical connection portions will be needed when the printhead 3 is to be attached to the printing apparatus 1 or when the printhead is to be replaced.

Electrothermal transducers (heaters) (not shown) are formed in correspondence with the respective orifices on each element substrate 10. Each electrothermal transducer causes ink to bubble by energizing and applying heat and causes the ink to be discharged from the orifice by this bubbling energy.

Figure 3:
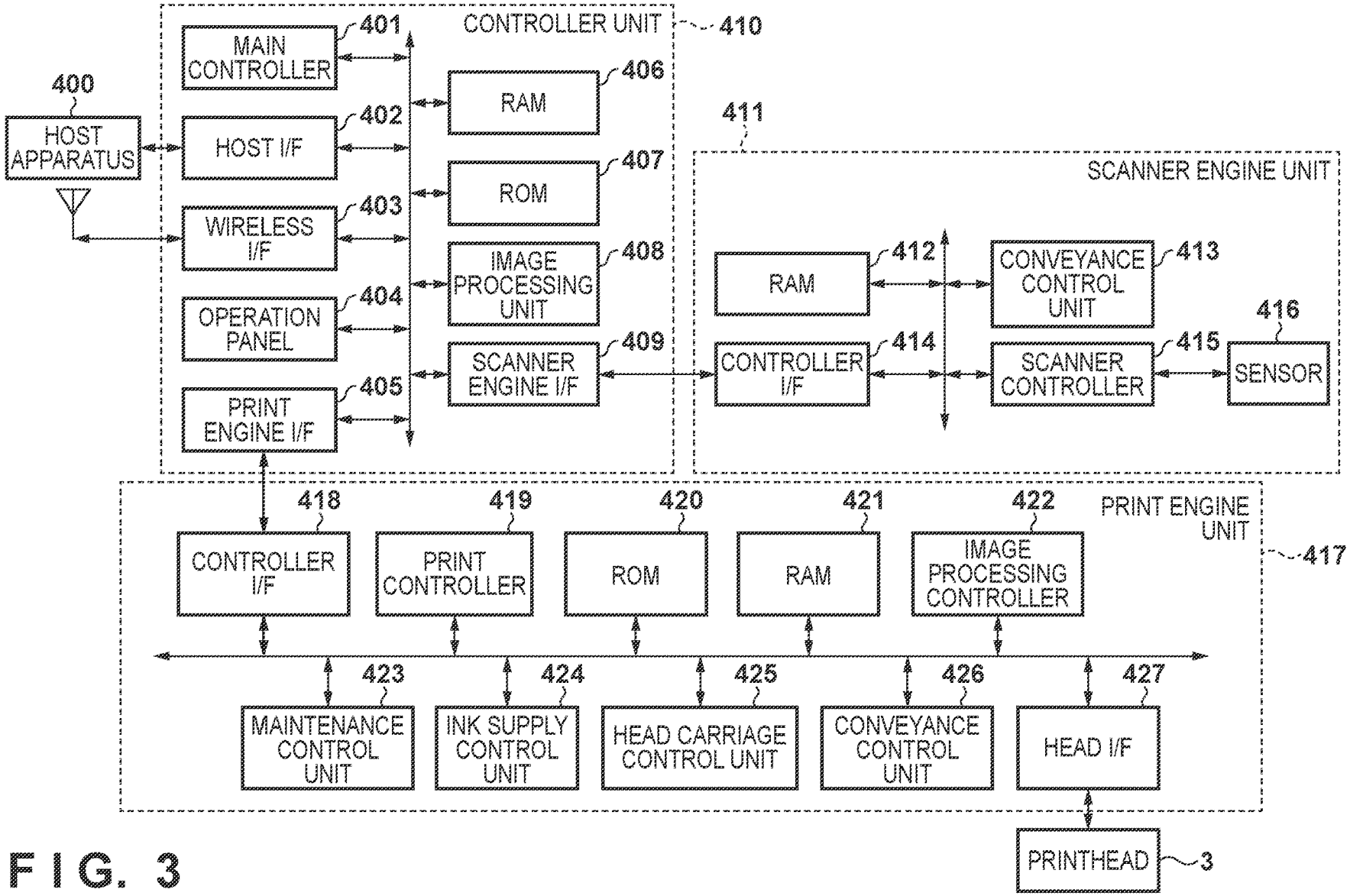
FIG. 3 is a block diagram showing the control arrangement of the printing apparatus shown in FIG. 1.

Description of Control Arrangement (FIG. 3)

FIG. 3 is a block diagram showing the arrangement of a control circuit of the printing apparatus 1.

As shown in FIG. 3, the printing apparatus 1 is formed by a print engine unit 417 which mainly controls a printing unit, a scanner engine unit 411 which mainly controls a scanner unit, and a controller unit 410 which controls the entire printing apparatus 1. A print controller 419 incorporating an MPU and a nonvolatile memory (EEPROM or the like) controls various kinds of mechanisms of the print engine unit 417 in accordance with instructions from a main controller 401 of the controller unit 410. The various kinds of mechanisms of the scanner engine unit 411 are controlled by the main controller 401 of the controller unit 410.

The control arrangement will be described in detail hereinafter.

In the controller unit 410, the main controller 401 which is formed by a CPU controls, by using a RAM 406 as a work area, the entire printing apparatus 1 in accordance with programs and various kinds of parameters stored in a ROM 407. For example, when a print job is input from a host apparatus 400 via a host I/F 402 or a wireless I/F 403, an image processing unit 408 will execute, in accordance with the instruction from the main controller 401, predetermined image processing on the received image data. The main controller 401 will subsequently transmit the image data that has undergone the image processing to the print engine unit 417 via a print engine I/F 405.

Note that the printing apparatus 1 may obtain the image data from the host apparatus 400 via wireless communication or wired communication or may obtain the image data from an external storage device (a USB memory or the like) connected to the printing apparatus 1. The communication method used in the wireless communication or the wired communication is not limited. For example, Wi-Fi® (Wireless Fidelity®) or Bluetooth® can be applied as the communication method to be used in the wireless communication. Also, a USB (Universal Serial Bus) or the like can be applied as the communication to be used in the wired communication. In addition, for example, when a read command is input from the host apparatus 400, the main controller 401 will transmit this command to the scanner engine unit 411 via a scanner engine I/F 409.

An operation panel 404 is a unit for a user to perform input/output on the printing apparatus 1. The user can instruct operations such as copying, scanning, and the like, set a print mode, and recognize information of the printing apparatus 1 via the operation panel 404.

In the print engine unit 417, the print controller 419 formed by a CPU controls, by using a RAM 421 as a work area, the various kinds of mechanisms of the print engine unit 417 in accordance with programs and various kinds of parameters stored in a ROM 420.

When various kinds of commands or image data is received via a controller I/F 418, the print controller 419 will temporarily store the received command or image data in the RAM 421. The print controller 419 causes an image processing controller 422 to convert the stored image data into print data so that the printhead 3 can use the print data during a printing operation. When the print data is generated, the print controller 419 causes, via a head I/F 427, the printhead 3 to execute a printing operation based on the print data. During this time, the print controller 419 drives a conveyance roller 28 and a LF roller 29 via a conveyance control unit 426 to convey a print medium 2. In accordance with the instruction of the print controller 419, the printing operation by the printhead 3 is executed in synchronization with the conveyance operation of the print medium 2, thereby executing the printing processing.

A head carriage control unit 425 changes the direction and the position of the printhead 3 in accordance with an operation state such as a maintenance state or a print state of the printing apparatus 1. An ink supply control unit 424 controls a liquid supplying unit (not shown) so that the pressure of the ink to be supplied to the printhead 3 will be contained within an appropriate range. A maintenance control unit 423 controls the operation of a cap unit and a wiping unit in a maintenance unit (not shown) when a maintenance operation is to be performed on the printhead 3.

In the scanner engine unit 411, the main controller 401 controls, by using the RAM 406 as a work area, hardware resources of a scanner controller 415 in accordance with programs and various kinds of parameters stored in the ROM 407. As a result, the various kinds of mechanisms included in the scanner engine unit 411 are controlled. For example, the main controller 401 can control, via a controller I/F 414, the hardware resources in the scanner controller 415 to convey, to a conveyance control unit 413, an original stacked on an ADF (not shown) by the user, and read the original by a sensor 416. Subsequently, the scanner controller 415 will store the read image data in a RAM 412.

Note that the print controller 419 can convert the image data that has been obtained as described above into print data to cause the printhead 3 to execute a printing operation based on the image data read by the scanner controller 415.

Figure 4:
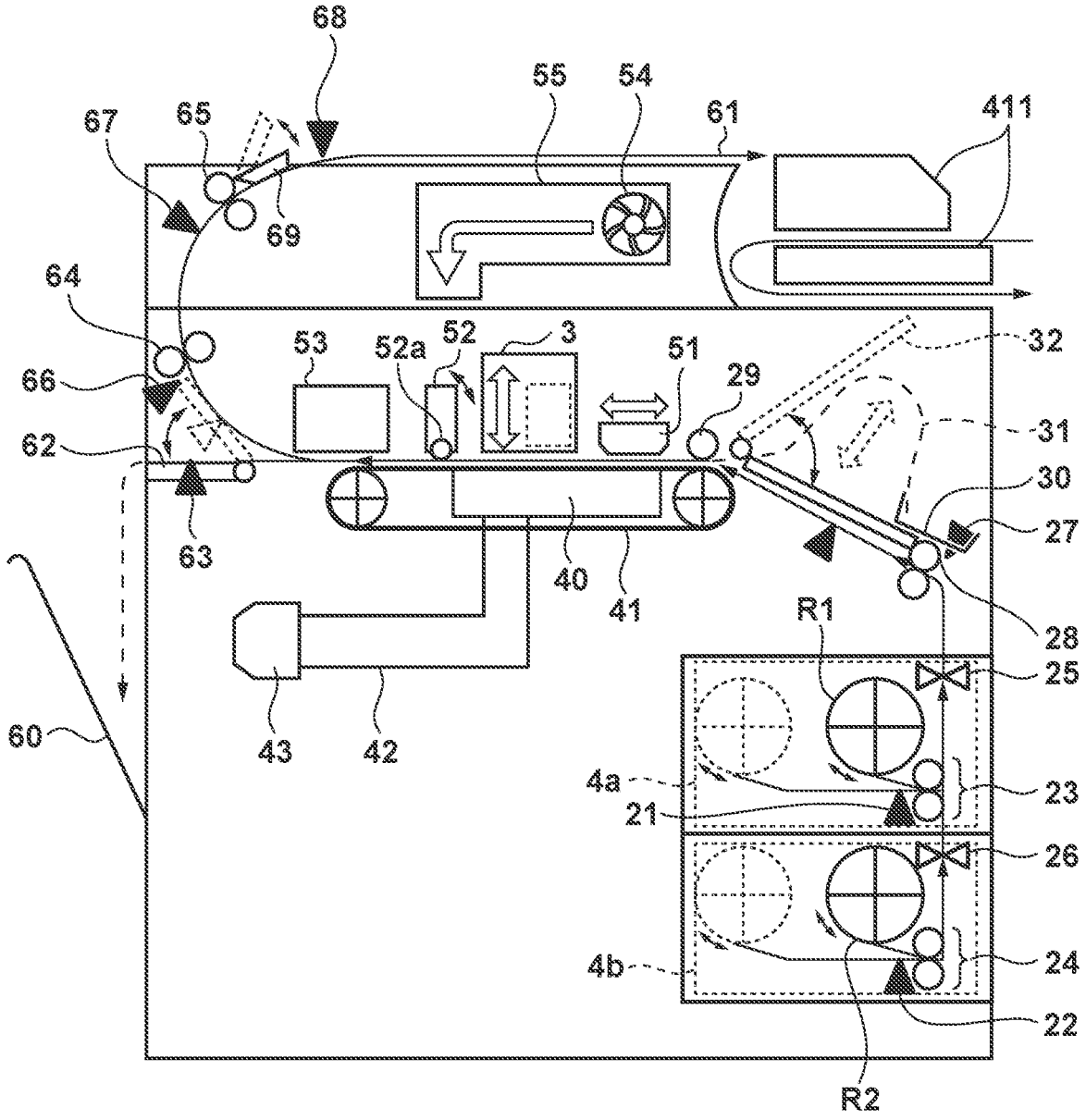
FIG. 4 is a view showing an outline of a side section of the printing apparatus shown in FIG. 1, and schematically shows the conveyance arrangement of a rolled sheet.

Description of Conveyance Arrangement of Rolled Sheet (FIG. 4)

FIG. 4 is a side sectional view of the printing apparatus 1 shown in FIG. 1, and schematically shows the conveyance arrangement of the rolled sheet. FIG. 4 shows a state in which a rolled sheet R1 is mounted to the rolled sheet attachment portion 4*a* and a rolled sheet R2 is mounted to the rolled sheet attachment portion 4*b*. When the user mounts the rolled sheet R1 to a portion indicated by broken lines of the rolled sheet attachment portion 4*a* in FIG. 4, the rolled sheet R1 rotates and moves to a hatched portion to be fixed and attached to the printing apparatus. In a similar manner, when the user mounts the rolled sheet R2 to a portion indicated by broken lines of the rolled sheet attachment portion 4*b*, the rolled sheet R2 rotates and moves to a hatched portion to be fixed and attached to the printing apparatus.

For example, when a feeding motor (not shown) attached to a rotation shaft of the rolled sheet attachment portion 4*a* is driven to print an image on the rolled sheet R1, the leading edge is fed out and is nipped by a pair of sheet feeding rollers 23 when the leading edge is detected by a sheet feeder sensor 21. Subsequently, the leading edge of the rolled sheet R1 is further conveyed by the rotation of the pair of sheet feeding rollers 23, and the leading edge portion of the rolled sheet R1 is cut by a cutter 25 to trim the shape of the rolled sheet R1.

In a similar manner, when a feeding motor (not shown) attached to a rotation shaft of the rolled sheet attachment portion 4*b* is driven to print an image on the rolled sheet R2, the leading edge is fed out and is nipped by a pair of sheet feeding rollers 24 when the leading edge is detected by a sheet feeder sensor 22. Subsequently, the leading edge of the rolled sheet R2 is further conveyed by the rotation of the pair of sheet feeding rollers 24, and the leading edge portion of the rolled sheet R2 is cut by a cutter 26 to trim the shape of the rolled sheet R2.

The rolled sheet whose leading edge has been trimmed by either the cutter 25 or 26 is further conveyed in the direction of an arrow. When the leading edge of the rolled sheet is detected by a leading edge detection sensor 27, the conveyance rollers are driven to start the rotation. Subsequently, the rolled sheet whose leading edge has been nipped by conveyance rollers 28 is further conveyed and reaches a LF roller 29. When the leading edge of the rolled sheet is nipped by the LF roller 29, the conveyance of the rolled sheet will be performed by the LF roller 29 and the conveyance rollers 28, and the rolled sheet will be conveyed on a conveyance belt 41. Note that a fixing guide 30 is arranged near the leading edge detection sensor 27 to support the smooth conveyance of the rolled sheet.

At this time, a loop 31, as indicated by broken lines in FIG. 4, will be formed by the rolled sheet when control is performed to slightly change a rotation speed V0 of the LF roller 29 and a rotation speed V of the conveyance rollers 28 from each other so that the rotation speed V will be slightly higher than the rotation speed V0. A flapper 32, whose one end is fixed and set to be rotatable by using this fixed portion as a rotation shaft, is configured to rotate in accordance with the formation of the loop 31 so as not to hinder the rolled sheet from being formed into a loop. Note that each of the rotation speed V0 of the LF roller 29 and the rotation speed V of the conveyance rollers 28 is controlled by the conveyance control unit 426 issuing a command to a corresponding motor which is used to drive the roller. Hence, since each roller rotates based on a corresponding command, the rotation speed of each roller can also be referred to as a command speed.

The rolled sheet will be further conveyed in this state and reach a printing position between the lower portion of the printhead 3 and a platen 40.

As shown in FIG. 4, the platen 40 is arranged, with respect to the conveyance direction of the rolled sheet, in the lower portion of the conveyance belt 41 for conveying the rolled sheet between the upstream side and the downstream side of the printhead 3, and the platen 40 is connected to a suction fan 43 via a duct 42. This kind of arrangement can prevent the rolled sheet from floating during the conveyance by causing the rolled sheet to be adhere to the conveyance belt 41 through the holes provided on the platen 40 by operating the suction fan 43 to generate a negative pressure by suctioning the air inside the duct 42.

In addition, in the conveyance direction of the rolled sheet, a recovery unit 51 is arranged on the upstream side and a cap 52 and a drying unit 53 are arranged on the downstream side of the printhead 3. As shown in FIG. 4, the recovery unit 51 can move the rolled sheet in the conveyance direction, and the cap 52 is configured to be rotatable about a rotation shaft 52*a*. Furthermore, as described above, the printhead 3 has a print width corresponding to the width of the rolled sheet as a print medium. Although the printhead 3 will be fixed during printing, it is configured to be movable in a vertical direction as shown by an arrow in FIG. 4 in cases other than the printing operation.

In a case in which, for example, the discharge state of the printhead 3 is to be recovered by such an arrangement, the printhead 3 will be moved upward, and the recovery unit 51 will move to the space created by this upward movement. Subsequently, the recovery unit 51 will execute a recovery operation by wiping an ink discharge surface of the printhead 3, suctioning the orifices, causing the printhead 3 to execute a preliminary discharge, and the like. Note that since these operations are well-known techniques, a description of these operations will be omitted.

On the other hand, in order to prevent the drying of the ink discharge surface of the printhead 3 in a case in which neither a printing operation nor a recovery operation is to be performed, the printhead 3 will be moved upward and the cap 52 will be rotated into the space created by this upward movement. Subsequently, the printhead 3 will be moved in downward so that the printhead 3 will be capped by the cap 52.

In addition, the drying unit 53 is operated to heat the surface of the rolled sheet to dry the rolled sheet when the printhead 3 has completed printing by discharging ink. This will prevent a state in which the inside of the apparatus (particularly, the conveyance path of the rolled sheet) will become contaminated with ink when a wet rolled sheet is further conveyed after printing. Furthermore, a fan 54 and a duct 55 are arranged on the upper portion of the printhead 3. The fan 54 can be operated to blow external air via the duct 55 in the direction of an arrow, and this air will promote the drying of the printed rolled sheet.

A printing length L in the conveyance direction of the rolled sheet can be set based on either a user instruction from the operation panel 100 or an instruction from the host apparatus 400. When the rolled sheet whose leading edge has been trimmed by one of the cutters 25 and 26 is confirmed to have been conveyed from this leading edge up to the printing length L, the trailing edge of the rolled sheet is cut by the corresponding one of the cutters 25 and 26.

The rolled sheet (to be referred to as a cut sheet hereinafter) that has been printed by the printhead 3 and whose trailing edge has been cut is discharged to a back basket 60 or a front stacker 61. The selection of the discharge location can be made based on either a user instruction from the operation panel 100 or an instruction from the host apparatus 400.

In a case in which the cut sheet is to be discharged to the back basket 60, a flapper 62 will be rotated to form a conveyance path in the direction of the back basket 60. As a result, the cut sheet will be conveyed by the rotation of the conveyance belt 41 and drop into the back basket 60 as indicated by broken lines in FIG. 4. Note that the leading edge detection, the passing, and the trailing edge detection of the cut sheet will be performed based an output signal from a sheet sensor 63.

In contrast, in a case in which the cut sheet is to be discharged to the front stacker 61, the flapper 62 will be rotated and positioned in the location indicated by fine broken lines to form a conveyance path in the direction of the front stacker 61. As a result, the cut sheet will be conveyed by the rotation of the conveyance belt 41, reach a pair of sheet discharge rollers 64, further reach a pair of sheet discharge rollers 65, and finally be discharged to the front stacker 61. Note that sheet sensors 66 and 67 and a sheet discharge sensor 68 are arranged in the conveyance path to the front stacker 61 so that the discharge state of the cut sheet will be detected. In addition, a trailing edge pressing lever 69 will be arranged between the pair of sheet discharge rollers 65 and the sheet discharge sensor 68 to prevent the trailing edge of the cut sheet from jumping and to support the smooth discharge of the cut sheet.

Note that the scanner engine unit 411 will read an image when the user inserts an original of the image in the direction of a solid line arrow. However, since a conventional arrangement may be used as the arrangement of the scanner engine unit 411, a description will be omitted here.

Next, the rolled sheet conveyance control that is to be executed in a printing apparatus which has the above arrangement will be described in detail hereinafter.

Figure 5:
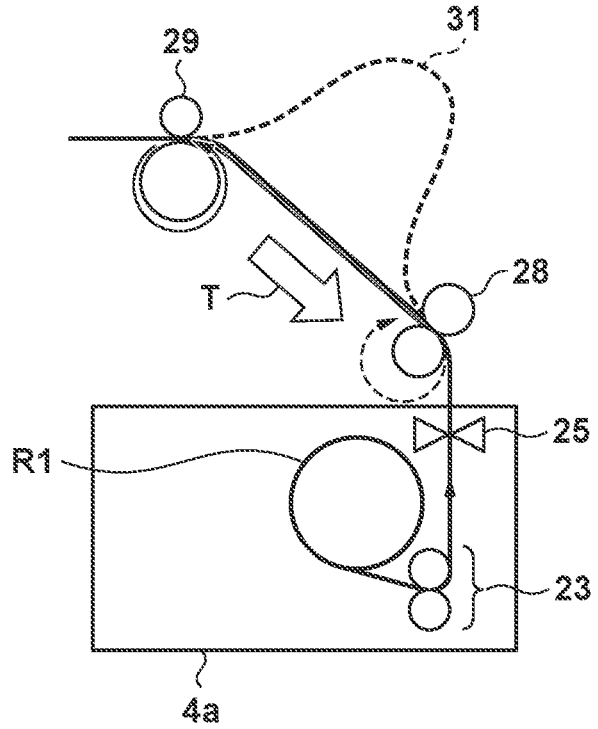
FIG. 5 is an enlarged view showing components for forming the rolled sheet into a loop.

FIG. 5 is an enlarged view showing the components which are to form the rolled sheet into a loop.

Note that for the sake of descriptive convenience, an example in which the rolled sheet R1 that is attached to the rolled sheet attachment portion 4*a* is fed and formed into a loop will be described in FIG. 5. A similar process will be performed in a case in which the rolled sheet R2 that is attached to the rolled sheet attachment portion 4*b* is fed and formed into a loop.

According to the arrangement shown in FIG. 5, the rolled sheet R1 fed from the rolled sheet attachment portion 4*a* is nipped by the pair of sheet feeding rollers 23, passes through the cutter 25, and reaches the conveyance rollers 28. The rolled sheet whose leading edge has been nipped by the conveyance rollers 28 is further conveyed and reaches the LF roller 29. In this manner, the rolled sheet is nipped by the conveyance rollers 28 (on the upstream side) and the LF roller 29 (on the downstream side).

In this state, as described above, the loop 31 will be formed by performing control to slightly change a rotation speed V0 of the LF roller 29 and a rotation speed V of the conveyance rollers 28 from each other so that the rotation speed V will be slightly higher than the rotation speed V0.

In this embodiment, while the rolled sheet is nipped by the conveyance rollers 28 and the LF roller 29 and an image is printed on the rolled sheet by the printhead 3, the rotation direction of the conveyance rollers 28 that function as intermediate rollers will be rotated in the reverse direction of the rotation direction of the LF roller 29. That is, in this embodiment, the rolled sheet will not be formed into a loop during printing, and tension will be applied in the direction of a large arrow shown in FIG. 5. In addition, the tension of the rolled sheet can be controlled by changing the driving torques of the conveyance rollers 28 by controlling the current applied to a conveyance motor (not shown).

Note that in a case in which the conveyance rollers 28 are to be rotated in the reverse direction of the rotation direction of the LF roller 29, a low rotation torque will be applied to the conveyance rollers 28, and control will be performed not to inhibit the conveyance of the rolled sheet by the rotation of the LF roller 29.

Figure 6:
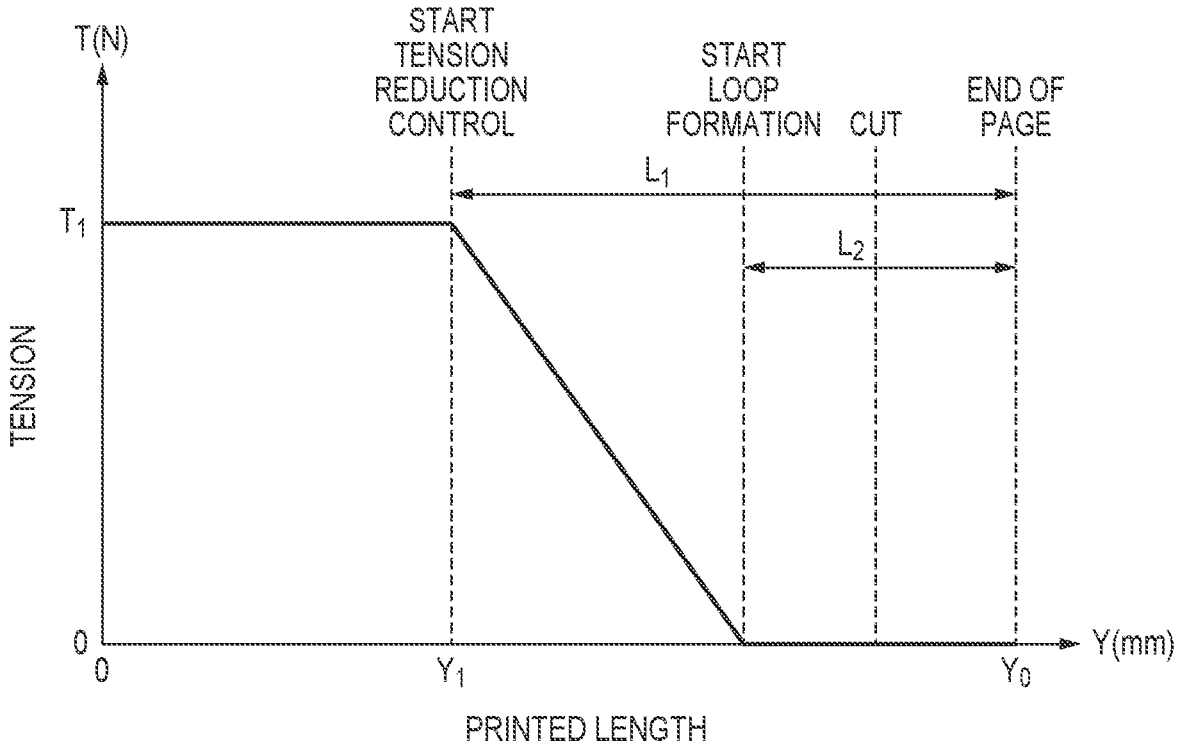
FIG. 6 is a graph showing the relationship between tension N applied to the rolled sheet between conveyance rollers and an LF roller and a printed length Y of the rolled sheet.

FIG. 6 is a graph showing the relationship between tension N applied to the rolled sheet between the conveyance rollers and the LF roller and a printed length Y of the rolled sheet. The printed length of the rolled sheet represents a conveyance amount of the rolled sheet from a printing position of the printhead 3 on the conveyance path of the rolled sheet. Hence, in FIG. 6, Y=0 of the printed length Y of the abscissa represents the position where the printhead 3 will start printing on the leading edge of the rolled sheet.

As shown in FIG. 6, when the printing is started and progresses, the magnitude of tension T will be maintained at $T_1$ until the rolled sheet is conveyed and the printed length Y reaches $Y=Y_1$. Here, $Y_1$ corresponds to a predetermined amount $L_1$ of a remaining length to the end of the page that is being printed. According to FIG. 6, when the remaining length to the end of the page that is being printed becomes equal to or less than the predetermined amount (that is, $Y \geq Y_1$), the tension T will be gradually reduced before the loop is to be formed to gradually change the conveyance amount of the rolled sheet. Subsequently, the tension T will be zero when the loop formation is to be started. At this point of time, the distance to the end of the page will be $L_2$.

In this manner, according to this embodiment, since the remaining conveyance amount will be small and the conveyance amount will not rapidly change even when the loop formation is started and no tension is applied on the rolled sheet, it will be possible to suppress the printing from becoming nonuniform in the conveyance direction.

Note that although FIG. 6 showed control in which the tension applied to the rolled sheet will be linearly reduced, the present disclosure is not limited to this. For example, control may be performed so that the tension will be reduced step by step.

Also, in a case in which the type of the rolled sheet is plain paper or the like in which the nonuniformity in printing due to the reduction of the tension will not be conspicuous, it will be preferable to delay, as much as possible, the timing at which the tension will reduced so that the reduction rate of the tension can be increased and the tension application length can be extended as much as possible. As a result, it will be possible to even further suppress the skewing and the meandering of the rolled sheet.

Figure 7:
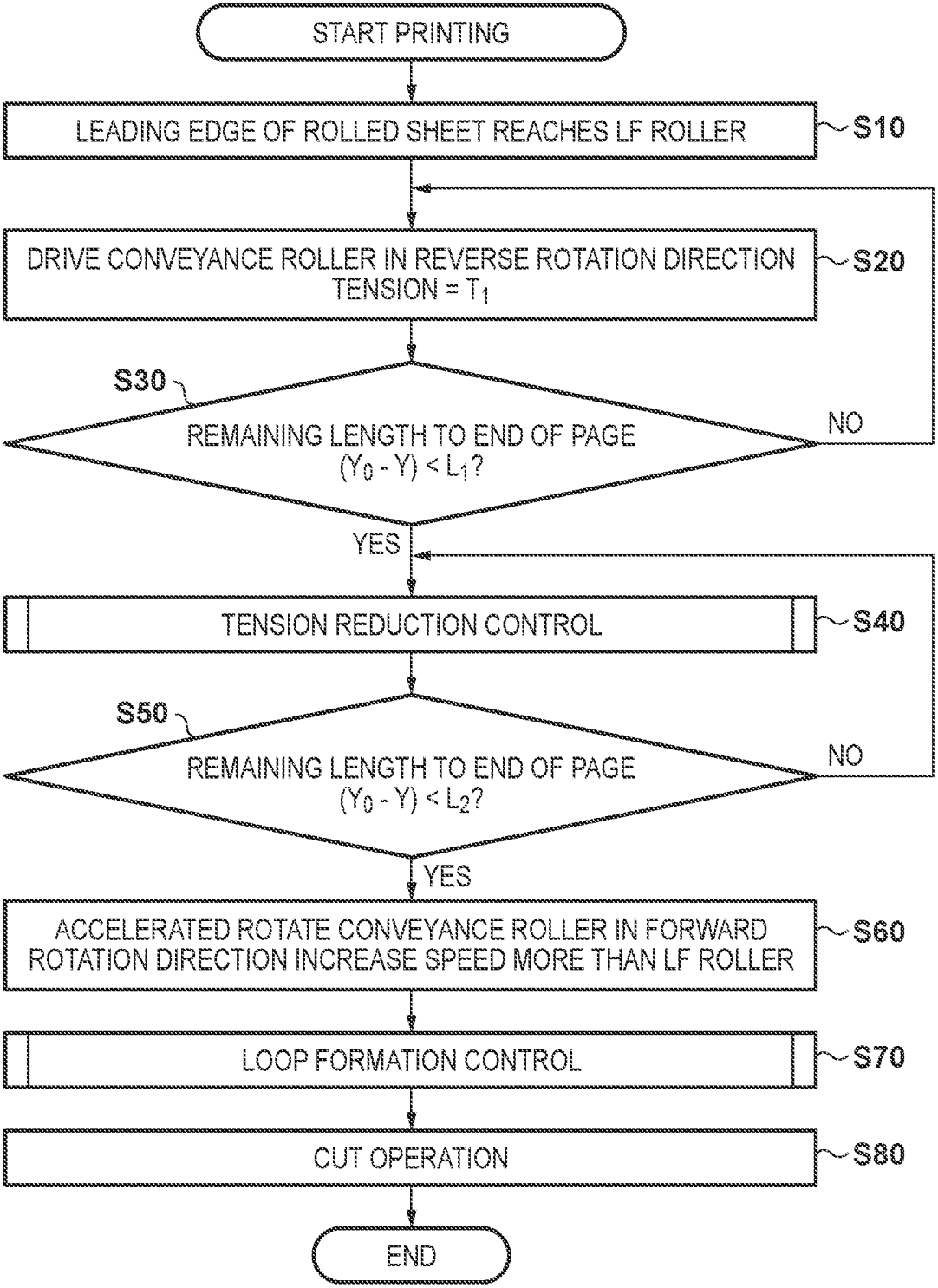
FIG. 7 is a flowchart showing tension reduction control and loop formation control.

FIG. 7 is a flowchart showing the tension reduction control and the loop formation control.

According to FIG. 7, in step S10, the rolled sheet is fed from the rolled sheet attachment portion, and the leading edge of the rolled sheet reaches the LF roller 29. As a result, the rolled sheet is nipped by the conveyance rollers 28 and the LF roller 29. Next, in step S20, the rotation of the conveyance motor is switched so as to set the rotation direction of the conveyance rollers 28 in the reverse direction of the rotation direction of the LF roller 29. Subsequently, tension of $T=T_1$ is applied to the rolled sheet between the conveyance rollers 28 and the LF roller 29 as shown in FIG. 6. In this manner, since the remaining printing length is sufficiently long at the beginning of the printing, tension will be applied to the rolled sheet to sufficiently suppress the skewing and the meandering of the rolled sheet.

Printing by the printhead 3 and the conveyance of the rolled sheet are continued. Next, in step S30, whether a remaining length $(Y_0-Y)$ of the page being printed has reached a tension reduction starting position (an $L_1$ position from the page end position) is checked. Here, if $Y_0-Y \geq L_1$, it will be determined that the remaining printing length is still sufficient, and the process will return to step S20 to continue the tension application to the rolled sheet. In contrast if $Y_0-Y<L_1$, it will be determined that the rolled sheet has reached the tension reduction starting position, and the process will advance to step S40.

In step S40, the rotation torque of the conveyance motor will be gradually lowered to reduce the magnitude of the tension T applied to the rolled sheet as shown in FIG. 6. Subsequently, whether the remaining length $(Y_0-Y)$ of the page being printed has reached a loop formation starting position (an $L_2$ position from the page end position) is checked. If the conveyance motor is a DC motor, the rotation torque can be changed by changing the duty ratio of the PWM control used for driving the DC motor.

Here, if $Y_0-Y \geq L_2$, it will be determined that the tension T is still being applied to the rolled sheet (T>0), and the process will return to step S40 to continue the reduction of the applied tension. In contrast, if $Y_0-Y<L_2$, it will be determined that the applied tension has become zero, the distance to the end of the page is sufficiently short, and the rolled sheet has reached the loop formation position. Subsequently, the process will advance to step S60.

Note that the applied tension need not be strictly 0 at the time of loop formation. The loop formation can be started as long as the amount of change of the tension has become sufficiently small.

In step S60, the rotation direction of the conveyance rollers 28 is reversed and set to the same direction as the rotation direction of the LF roller 29, and the rotation speed is increased. Next, in step S70, the loop 31 by controlling the conveyance motor so that the rotation speed V of the conveyance rollers 28 will be slightly higher than the rotation speed V0 of the LF roller 29.

When the loop is formed, the sheet feeding by the pair of sheet feeding rollers 23 is stopped and the cutter 25 is operated to cut the rolled sheet in the process of step S80. Subsequently, the processing ends.

Therefore, according to the above-described embodiment, while printing a single page by using a rolled sheet, tension will be applied on the rolled sheet between the conveyance rollers and the LF roller. As the remaining printing length decreases, the tension will be gradually reduced to form the rolled sheet into a loop, and, finally, the rolled sheet will be cut. Since the rolled sheet will be suppressed from skewing and meandering by applying tension to the rolled sheet during printing, and the rolled sheet will be cut by forming a loop by gradually reducing the tension in a portion at the end of the printing, the tension will not change rapidly, and the conveyance amount of the rolled sheet will not be influenced. As a result, highly precise conveyance control will be achieved, and high quality image printing will be implemented.

Note that although a printing apparatus that uses a full-line printhead was exemplified in the above-described embodiment, the present disclosure is also applicable to a serial-type printing apparatus that performs printing by reciprocally scanning a printhead mounted on a carriage. However, in such a case, the appearance of image nonuniformity will change depending on the degree of image overlay by multi-pass printing. For example, since the nonuniformity of the image will be conspicuous in single-pass printing, the reduction ratio of the tension will need to be controlled more gradually in the tension reduction control.

In addition, in the above-described embodiment, the driving pulse that drives the conveyance motor may be changed between a period in which a constant tension is applied to the rolled sheet from immediately after the start of printing to the start of tension reduction control and a period in which the tension is set to zero at the time of loop formation. By executing such variable control, it will be possible to execute control so as to further reduce the difference between the conveyance amount by the rotation of the conveyance motor and the actual conveyance amount of the rolled sheet.

Other Embodiment

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-085493, filed May 14, 2020, which is hereby incorporated by reference herein in its entirety.

What is claimed is:

1. A printing apparatus to convey a print medium that is continuous and to use a print unit to perform printing on the conveyed print medium, comprising:

a feeding unit configured to feed the print medium;

a conveyance unit configured to nip the print medium conveyed from the feeding unit by a first roller and a second roller which is arranged closer to a downstream side than the first roller with respect to a conveyance direction of the print medium, and to convey the nipped print medium;

a cutting unit configured to cut the print medium, wherein the cutting unit is arranged closer to an upstream side than the first roller with respect to the conveyance direction of the print medium; and a control unit configured to control the conveyance of the print medium and an operation of the cutting unit, wherein the control unit:

(1) performs control to make a command speed of the first roller lower than a command speed of the second roller until printing by the print unit reaches near a trailing edge of a printing length after the print unit has started the printing on the print medium conveyed by the conveyance unit, (2) performs control to make the command speed of the first roller higher than the command speed of the second roller when the printing by the print unit has reached near the trailing edge of the printing length, and (3) subsequently performs control to control the cutting unit configured to cut the print medium.

2. The printing apparatus according to claim 1, wherein the control unit further:

(1-1) performs control to apply tension to the print medium by setting a rotation direction of the first roller, which is based on the command speed of the first roller, to be a reverse direction of a rotation direction of the second roller, which is based on the command speed of the second roller, until the printing by the printhead reaches near the trailing edge of the printing length after the printhead has started the printing on the print medium conveyed by the conveyance unit, (2-1) performs control to reduce the tension by lowering a rotation torque of the first roller when the printing by the printhead has reached near the trailing edge of the printing length, (2-2) causes a loop of the print medium to be formed in a conveyance path of the print medium between the first roller and the second roller by setting the rotation direction of the first roller and the rotation direction of the second roller to be the same direction at a point of time at which the tension becomes zero, and (3-1) controls the cutting unit configured to cut the print medium in which the loop has been formed.

3. The printing apparatus according to claim 2, wherein the control unit is configured to change the rotation torque of the first roller, and wherein a motor configured to rotate the first roller is a direct current (DC) motor which is controlled by pulse width modulation (PWM) control, and the control unit changes a duty ratio for the PWM control to change the rotation torque of the first roller.

4. The printing apparatus according to claim 3, wherein, in reducing the rotation torque of the first roller, the rotation torque of the first roller is reduced linearly.

5. The printing apparatus according to claim 3, wherein, in reducing the rotation torque of the first roller, the rotation torque of the first roller is reduced step by step.

6. The printing apparatus according to claim 3, wherein the control unit performs control to change a driving pulse of the motor between a period in which the printing by the printhead is started until the printing by the printhead reaches near the trailing edge of the printing length and a period in which the loop is formed.

7. The printing apparatus according to claim 2, wherein the control unit applies constant tension to the print medium until the printing by the printhead is started and the printing reaches near the trailing edge of the printing length.

8. The printing apparatus according to claim 2, wherein, in accordance with a type of the print medium, the control unit changes the control to reduce the tension.

9. The printing apparatus according to claim 2, wherein the print medium is a rolled sheet.

10. The printing apparatus according to claim 2, wherein the printing apparatus is a serial-type printing apparatus, the printing apparatus according further comprising a carriage configured to mount the printhead and reciprocally scan, wherein the carriage can perform multi-pass printing by using the printhead mounted on the carriage, and wherein, in accordance with the number of passes in the multi-pass printing, the control unit changes the control to reduce the tension.

11. The printing apparatus according to claim 1, wherein the printhead is a full-line printhead that has a printing width corresponding to a width of the printed medium.

12. A conveyance controlling method for a printing apparatus to convey a print medium that is continuous and to use a printhead to perform printing on the conveyed print medium, the conveyance controlling method comprising:

feeding the print medium;

nipping the print medium conveyed from the feeding by a first roller and a second roller which is arranged closer to a downstream side than the first roller with respect to a conveyance direction of the print medium, and conveying the nipped print medium;

cutting the print medium by a cutter, wherein the cutter is arranged closer to an upstream side than the first roller with respect to the conveyance direction of the print medium; and controlling the conveyance of the print medium and an operation of the cutter, wherein controlling includes:

(1) performing control to make a command speed of the first roller lower than a command speed of the second roller until printing by the printhead reaches near a trailing edge of a printing length after the printhead has started the printing on the conveyed print medium, (2) performing control to make the command speed of the first roller higher than the command speed of the second roller when the printing by the printhead has reached near the trailing edge of the printing length, and (3) subsequently performing control to control the cutter configured to cut the print medium.

* * * * *